United States Patent [19]

Mecke et al.

[11] Patent Number: 4,744,685

[45] Date of Patent: May 17, 1988

[54] THERMAL TRANSFER RIBBON AND METHOD OF MAKING SAME

[75] Inventors: Norbert Mecke; Rüdiger Weiss, both of Hanover; Otto Jung, Laatzen, all of Fed. Rep. of Germany

[73] Assignee: Pelikan Aktiengesellschaft, Hanover, Fed. Rep. of Germany

[21] Appl. No.: 878,747

[22] Filed: Jun. 26, 1986

[30] Foreign Application Priority Data

Jun. 26, 1985 [DE] Fed. Rep. of Germany ..... 3522801

[51] Int. Cl.[4] ..... B41J 3/20; B41J 31/06; B41M 5/00

[52] U.S. Cl. ..... 400/241.4; 400/120; 427/146; 428/913; 428/914

[58] Field of Search ..... 400/120, 241, 241.1, 400/241.2, 241.4; 428/913, 914; 427/146

[56] References Cited

U.S. PATENT DOCUMENTS

| | | | |
|---|---|---|---|
| 3,904,802 | 9/1975 | Brown | 428/914 X |
| 3,922,438 | 11/1975 | Brown | 427/146 X |
| 4,128,430 | 12/1978 | Newman | 101/451 X |
| 4,465,389 | 8/1984 | Knirsch | 400/120 X |
| 4,472,479 | 9/1984 | Hayes | 400/241.4 X |
| 4,533,596 | 8/1985 | Besselman | 400/120 X |
| 4,547,088 | 10/1985 | Shattuck | 400/120 X |
| 4,569,609 | 2/1986 | Snyder | 400/241.1 X |
| 4,592,945 | 6/1986 | Mecke | 400/120 X |

OTHER PUBLICATIONS

Fluorad Netzmittel (furnished by 3M Deutschland GmbH) (Information) (2 pages).

Technical Memo Emulan-Marken (publ. by Basf M5220d (7104), Aug. 1976) (4 pages.

Memo Ehaflex Ehaflex-Dispersionen (Type 5601) (4 pages).

Russpraparation fur Druckfarben, Lacke, Kunststoffe, Papier, Baustoffe by Degussa (2 pages).

Memo Ehaflex by Akzo Chemie (Ehaflex-Dispersion) (5 pages).

Etingal L-Vielseitig verwendbarer Schaumverhuter fur die Papierindustrie by Badische Anilin-& Soda Fabrik AG M 5133d, Sep. 1970.

*Primary Examiner*—Paul T. Sewell

*Attorney, Agent, or Firm*—Karl F. Ross; Herbert Dubno

[57] ABSTRACT

A thermal transfer ribbon consisting of a color-transfer layer on a foil or film substrate band is provided with a wax coating which appears to facilitate transfer with high resolution even to rough papers.

19 Claims, 1 Drawing Sheet

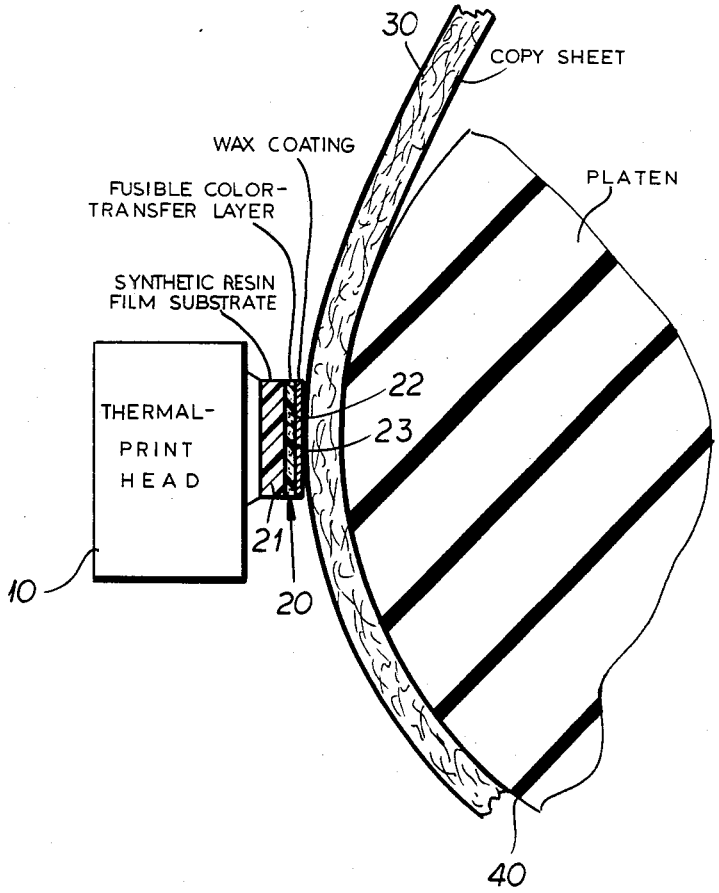
30
COPY SHEET
WAX COATING
PLATEN
FUSIBLE COLOR-
TRANSFER LAYER
SYNTHETIC RESIN
FILM SUBSTRATE
THERMAL-
PRINT
HEAD
22
23
21
10
20
40

THERMAL TRANSFER RIBBON AND METHOD OF MAKING SAME

FIELD OF THE INVENTION

Our present invention relates to a thermal transfer ribbon, i.e. a ribbon which can be used with thermal print heads of data-processing printers, typewriters and the like. These ribbons are also referred to variously as thermal color ribbons and thermal carbon ribbons, or film ribbons. They can comprise a synthetic resin foil substrate as a carrier band or strip, a synthetic resin bonded pigment or dyestuff containing color-transfer layer applied to a surface of the band or film which is to confront a copy sheet, and, in some cases, to an intervening layer or intervening layers between the support foil and the color-transfer layer to permit transfer of color in an image-correct pattern of heating to the copy sheet.

The invention also relates to a method of making the improved thermal transfer ribbon.

BACKGROUND OF THE INVENTION

In the past, thermal transfer ribbons have generally comprised a foil-like carrier, support or substrate, e.g. a paper or synthetic resin, a fusible color-transfer layer in the form of a wax-bonded dyestuff or pigment, and, in some cases, intervening layers between the substrate and the color transfer layer to facilitate such transfer if desired in the form of an image with the desired degree of resolution or definition.

When the term "color" is used herein, it will be understood to mean any dyestuff or pigment which is conventionally used in such color transfer layers and is intended to display the image of the heated pattern applied to the support foil by transfer to the colored layer or the coloring matter to the copy sheet. Since the term "color" includes black, as these expressions are used here, the pigment may be carbon black and the ribbon may be a thermal carbon ribbon.

The term "foil" as used herein is intended also to include support films and hence the ribbons involved may be of the type also known as film ribbons.

The ribbons generally pass between a thermal print head and the copy sheet. The thermal print head is provided with means adapted to apply heat and pressure in varying patterns to the support foil and to thereby cause melting of the transfer layer on the opposite surface of this foil and bonding of the material of the transfer layer to the copy sheet in the predetermined pattern. The print head may form a dot matrix printer and at each point or dot represented by a pin adapted to bear upon the ribbon, a corresponding dot is transferred to the copy sheet so as to form a printed symbol, e.g. an alphanumeric character. A thermal printer of the type with which the ribbon of the invention may be used is described, for example, in German open application DE-OS No. 3 224 445.

Customarily the thermal print head is pressed by a spring against the thermal transfer ribbon which is juxtaposed with a portion of the copy sheet lying against the platen of the printer, i.e. a roll which can be rotated to advance the copy sheet line-by-line relative to the print head.

The heating, in accordance with the alphanumeric character patterns, is effected at temperatures up to around 400° C. to melt the transfer layer in accordance with the pattern developed by the print head and the molten material adheres to the paper or copy sheet to which it remains adherent as the copy sheet and the ribbon are relatively displaced. The used portion of the ribbon may be continuously taken up by a takeup spool.

Wax-bonded color-transfer layers are problematical to handle since the color can come off on the hands of the user or on surfaces which are contacted by the ribbon even in the absence of thermal activation temperatures. Furthermore, effective transfer of the color to the paper for good resolution and definition requires that the copy sheet or paper to which the transfer is made be relatively smooth.

Since it is also desirable to have good resolution and definition on somewhat rougher papers and to avoid the undesirable color transfer to the hands of the user and other objects, considerable research has been expended in developing an improved thermal transfer ribbon. Thus it has been found that the use of a synthetic resin or thermoplastic material as a binder for the color transfer layer can avoid the above-mentioned problems.

However, other problems have a risen when synthetic resin bonded color-transfer layers have been used. The color sharpness was relatively poor, for example.

OBJECTS OF THE INVENTION

It is, therefore, the principal object of the present invention to provide an improved thermal transfer ribbon which overcomes drawbacks of prior art color-transfer ribbons, especially thermocolor and thermocarbon ribbons.

Yet another object of the invention is to provide a thermal transfer ribbon which has advantages of both the wax bonded and synthetic resin bonded color-transfer layers, but yet is free from the drawbacks associated therewith.

SUMMARY OF THE INVENTION

We have now found that these objects and others which will become apparent hereinafter can be attained by providing a thin wax layer upon the surface of the synthetic resin bonded fusible color layer turned toward the copy sheet and turned away from the support upon which the color transfer layer is provided.

More particularly, the thermal transfer ribbon of the invention can comprise a substrate constituted of a synthetic resin foil band, a fusible synthetic resin bonded color-transfer layer on a surface of this foil and responsive to heat for transfer of an image upon heating, and a wax layer on a surface of the fusible layer facing away from the substrate. The wax layer should have a thickness of substantially 0.5 to 3 microns (micrometers).

It is indeed surprising that when one applies a wax layer to such synthetic resin color-transfer layer, one can eliminate the resolution and definition problems previously associated with such resin bonded layers, even with respect to rough-surfaced papers while at the same time gaining the advantage that inadvertent color transfer to the hands and other objects is precluded.

The support or film can be a thermoplastic synthetic resin foil with a relatively high softening point, especially a softening point above 190° C., although in a less preferred embodiment, the support can be paper or the like.

The fusible color-transfer layer of the invention utilizes a synthetic resin and specifically a thermoplastic synthetic resin as a binder and the softening point thus plays an important role during the melting of the transfer layer. Preferably the softening point of the thermoplastic material forming this binder should be between 60° and 140° C., although the more preferred range is 70° to 120° C. with the best result being obtained between 70° and 90° C.

Naturally the most advantageous range will depend upon the thermoplastic material used and these can be especially polystyrene, polyamides, polyvinyl acetate, ethylene-vinylacetate copolymers, polymethacrylate and/or polyacrylates.

Various additives can be included in the fusible color-transfer layer, and these can include plasticizers, wetting agents, or surfactants, defoamers (for example based upon phosphate acid esters like Etingal L), fillers and adhesive-enhancing compounds, especially terpene phenol resins, glycerine resin esters and hydrocarbon resins (e.g. Ehatex KA 300 and Ehatex 12-1).

The colorant can be any conventional coloring agent, for example pigments such as carbon black, or solvent and/or binder-soluble dyestuffs, such as a commercial product known as Basoprint as well as various azo dies, such as ceres dyestuffs and sudan dyestuffs.

Carbon black is the preferred pigment.

As to the wax coating along the outer surface, we prefer to use materials characterized by the following properties:

At temperatures up to 20° C., it should not be kneadable and it should be solid to brittle, large to fine crystalline and transparent to opaque.

At temperatures between 20° and 40° C. it may develop fusibility or meltability although remaining of comparatively low viscosity and with little tendency toward ropiness.

The wax can be selected from the group which consists of paraffin waxes, silicone waxes, natural waxes (especially carnauba, beeswax and ozocerite) and synthetic waxes (especially acid waxes, unsaponified ester waxes, partially saponified ester waxes and polyethylene waxes).

Preferably the wax layer has a thickness of 0.5 to 3 microns (micrometers) although a range of 0.5 to 7 microns can be used, with the preferred range being 1 to 3 microns.

The color-transfer layer can have a corresponding thickness with a preferred thickness in the range of 1 to 3 micrometers. It should be noted that within the range the particular thickness for either layer does not appear to be critical. It is, however, important that the thermal printer heat be capable of transferring sufficient heat so that at the pressure applied by this heat, the melting process required for transfer can occur.

While the ribbon of the invention can be made in various ways, it has been found to be advantageous to spray or print a dispersion, either in water or in organic solvent of the materials forming the color-transfer layer onto the surface of the substrate film or foil, to evaporate the water or solvent and then in a similar way to apply the wax layer. Either layer can be applied by drawing it in the form of an aqueous suspension of the materials to form the layer in finely divided form. This is of course particularly advantageous because it avoids environmental pollution.

Consequently, according to the invention, the aqueous suspension of the finely divided materials adapted to form the color-transfer layer is coated onto the film or foil, and the water is evaporated. The materials contained in the suspension include, in addition to the thermoplastic binder, the coloring agent and any desired other additives.

After the formation of this layer, an aqueous suspension of the finely divided wax material is applied to the previously formed layer and the water is evaporated.

We should point out that we are not certain why our invention gives rise to the unique effects described since the wax coating is applied to a synthetic resin layer which, from experiences with such layers directly, one would expect poor resolution. Apparently, although we do not want to be bound by this explanation, the wax layer upon transfer to the copy sheet, acts as an affinity-improving substance, facilitating the transfer of the color layer to the paper. The wax itself may have a greater affinity or adhesion to the paper so that the overall bond between the pigment and the paper is improved while the danger of bleeding of the color is minimized.

Erasure is possible utilizing conventional erasers and this presumably is a result of an ability to remove pigment while leaving the wax on the paper. An overstrike of an erased region is thereby facilitated.

Liftoff of misstrikes using conventional liftoff correction materials is likewise facilitated.

An important advantage of the invention is that it allows the use of plain paper for printing or typewriting and indeed even comparatively rough or uncalendered papers while achieving high resolution.

BRIEF DESCRIPTION OF THE DRAWING

The above and other objects, features and advantages of the present invention will become more readily apparent from the following description, reference being made to the sole FIGURE which is a diagrammatic cross sectional view illustrating the invention.

SPECIFIC DESCRIPTION

In the drawing we have shown a thermal printer head 10 which is juxtaposed with a thermal transfer ribbon 20 in accordance with the invention to print alpha numeric characters, for example on a plain paper copy sheet 30 lying against a platen 40. Specifically, the ribbon 20 comprises a synthetic resin thermoplastic film substrate 21 to which has been applied the fusible color-transfer layer 22 which, in accordance with the invention, has been coated with a wax layer 23. In operation, alphanumeric characters utilizing a dot matrix pressure upon the ribbon transfers that color from the ribbon to the copy sheet 30.

SPECIFIC EXAMPLE

The substrate is a polyethylene terephthalate vinyl having a thickness of 6 micrometers (softening point about 260° C.).

This band is coated on one side with an aqueous dispersion consisting of 60 parts by weight of a 30% aqueous ethylene-vinyl acetate dispersion (Ehatex 5601), 10 parts by weight of a 50% aqueous dispersion of terpenephenol resin (Ehatex KA 300), 10 parts by weight of a carbon black dispersion (15% in water with 6% of an anion-active wetting agent-Derussol A), 19.9 parts by weight water, and 0.1 part by weight of a wetting agent in the form of a nonionic fluorotenside/fluorate FC-430/3 M. This dispersion is doctored onto the support in a thickness of 2 micrometers and the water is evaporated in an air stream at a temperature of 70° C.

On the dry color-transfer layer, the wax dispersion is applied.

The aqueous dispersion of the wax had the following composition:

32 parts by weight of an ester wax (Montan ester wax/LG-wax), 8 parts by weight of a fatty alcohol ethoxylate Emulan OSN, and 60 parts by weight water.

The aqueous wax dispersion is likewise applied with a doctor blade and the thickness was 2 microns. Water was evaporated in the manner described.

The ribbon was cut into lengths and rolled upon spools. Smearing was no problem and the ribbon could be used effectively for thermal printing in the manner described.

We claim:

1. A thermal transfer ribbon comprising:

a substrate constituted of a synthetic-resin foil band;

a fusible synthetic-resin-bonded color-transfer layer on a surface of said foil and responsive to heat for transfer of an image upon heating; and a further layer on a surface of said fusible synthetic-resin-bonded color-transfer layer facing away from said substrate consisting of wax.

2. The thermal transfer ribbon defined in claim 1 wherein said wax layer has a thickness of substantially 0.5 to 3 micrometer.

3. The thermal transfer ribbon defined in claim 1 wherein said wax layer is composed of a wax selected from the group which consists of natural waxes, paraffin waxes, silicone waxes, and synthetic waxes.

4. The thermal transfer ribbon defined in claim 3 wherein said wax is a natural wax selected from the group which consists of carnauba wax, beeswax and ozocerite.

5. The thermal transfer ribbon defined in claim 3 wherein said wax is a synthetic wax selected from the group which consists of acid waxes, unsasponified ester waxes, partially saponified ester waxes, polyethylene waxes, and mixtures thereof.

6. The thermal transfer ribbon defined in claim 1 wherein said fusible synthetic-resin-bonded color-transfer layer contains a thermoplastic binder with a softening point of about 70° to about 120° C.

7. The thermal transfer ribbon defined in claim 1 wherein said synthetic-resin foil band is composed of a thermoplastic material having a softening point in excess of 190° C.

8. The thermal transfer ribbon defined in claim 7 wherein said thermoplastic material is a polyester film.

9. The thermal transfer ribbon defined in claim 1 wherein said fusible synthetic-resin-bonded color-transfer layer contains a thermoplastic binder selected from the group which consists of a polystyrene, a polyamide, a polyvinylacetate, an ethylene-vinylacetate copolymer, a polymethacrylate, a polyacrylate and mixtures thereof.

10. A method of making a thermal transfer ribbon comprising:

a substrate constituted of a synthetic-resin foil band:

a fusible synthetic-resin-bonded color-transfer layer on a surface of said foil and responsive to heat for transfer of an image upon heating; and a further layer on a surface of said fusible synthetic-resin-bonded color-transfer layer facing away from said substrate consisting of wax, said method comprising the steps of:

coating said fusible synthetic-resin-bonded color-transfer layer onto said band in the form of an aqueous suspension and evaporating water from said suspension to form said synthetic-resin-bonded color-transfer layer thereon; and coating said further layer of wax onto said fusible synthetic-resin-bonded color-transfer layer in the form of an aqueous suspension and evaporating water from the latter aqueous suspension.

11. The method defined in claim 10 wherein said wax layer has a thickness of substantially 0.5 to 3 micrometer.

12. The thermal transfer ribbon defined in claim 11 wherein said wax layer is composed of a wax selected from the group which consists of natural waxes, paraffin waxes, silicone waxes, and synthetic waxes.

13. The method defined in claim 12 wherein said wax is a natural wax selected from the group which consists of carnauba wax, beeswax and ozocerite.

14. The method defined in claim 12 wherein said wax is a synthetic wax selected from the group which consists of acid waxes, unsaponified ester waxes, partially saponified ester waxes, polyethylene waxes, and mixtures thereof.

15. The method defined in claim 12 wherein said fusible synthetic-resin-bonded color-transfer layer contains a thermoplastic binder with a softening point of about 70° to about 120° C.

16. The method defined in claim 15 wherein said synthetic-resin foil band is composed of a thermoplastic material having a softening point in excess of 190° C.

17. The method defined in claim 16 wherein said thermoplastic material is a polyester film.

18. The method defined in claim 17 wherein said fusible synthetic-resin-bonded color-transfer layer contains a thermoplastic binder selected from the group which consists of a polystyrene, a polyamide, a polyvinylacetate, an ethylene-vinylacetate copolymer, a polymethacrylate, a polyacrylate and mixtures thereof.

19. The method defined in claim 18 wherein said synthetic-resin-bonded color-transfer layer contains a carbon pigment and said thermal transfer ribbon is a thermocarbon ribbon.

* * * * *